US009718647B2

(12) United States Patent
Makovec et al.

(10) Patent No.: US 9,718,647 B2
(45) Date of Patent: Aug. 1, 2017

(54) PALLET OF A MOVING WALKWAY

(71) Applicant: Inventio AG, Hergiswil (CH)

(72) Inventors: Christoph Makovec, Wiener Neustadt (AT); Michael Matheisl, Vösendorf (AT); Robert Schulz, Vienna (AT); Thomas Illedits, Neufeld (AT); Uwe Hauer, Nienburg (DE); Werner Eidler, Göllersdorf (AT)

(73) Assignee: Inventio AG, Hergiswil (CH)

( * ) Notice: Subject to any disclaimer, the term of this patent is extended or adjusted under 35 U.S.C. 154(b) by 0 days.

(21) Appl. No.: 14/906,646

(22) PCT Filed: Jul. 8, 2014

(86) PCT No.: PCT/EP2014/064619
§ 371 (c)(1),
(2) Date: Jan. 21, 2016

(87) PCT Pub. No.: WO2015/010894
PCT Pub. Date: Jan. 29, 2015

(65) Prior Publication Data

US 2016/0176681 A1 Jun. 23, 2016

(30) Foreign Application Priority Data

Jul. 26, 2013 (EP) ..... 13178135

(51) Int. Cl.
*B66B 21/00* (2006.01)
*B66B 23/10* (2006.01)
*B66B 21/10* (2006.01)

(52) U.S. Cl.
CPC ..... *B66B 23/10* (2013.01); *B66B 21/10* (2013.01)

(58) Field of Classification Search
CPC ..... B66B 23/10; B66B 21/10
USPC ..... 198/326–333
See application file for complete search history.

(56) References Cited

U.S. PATENT DOCUMENTS 1,956,714 A * 5/1934 Graff-Baker ..... B66B 23/02 198/330
5,595,278 A * 1/1997 Ostermeier ..... B66B 23/10 198/326
7,410,043 B2 * 8/2008 Aulanko ..... B66B 23/10 198/333
9,394,143 B2 * 7/2016 Makovec ..... B66B 23/022
(Continued)

FOREIGN PATENT DOCUMENTS

CN 102145850 A 8/2011
CN 103130083 A 6/2013
(Continued)

*Primary Examiner* — William R Harp
(74) *Attorney, Agent, or Firm* — Ladas & Parry LLP

(57) ABSTRACT

A moving walkway pallet is composed of a series of plates of a plate belt arranged to circulate between two deflecting regions of the walkway. Each plate has a base body with a base surface to which a tread element can be attached. The plates are pivotally connected to each other along pivot axes (SA) extending across a width (B) of the plates. The pivot axis is located either in a plane containing the base surface or above the side of the plane, remote from the base body. The base body has a width base body cross-section having a geometric center of gravity arranged below the base surface.

20 Claims, 3 Drawing Sheets

(56) References Cited

U.S. PATENT DOCUMENTS

| | | | | |
|---|---|---|---|---|
| 2004/0035674 | A1* | 2/2004 | Inoue | B66B 23/12 198/321 |
| 2007/0036626 | A1 | 2/2007 | Aulanko | |
| 2008/0257690 | A1 | 10/2008 | Ozaki | |
| 2010/0012456 | A1 | 1/2010 | Magaldi | |
| 2016/0176681 | A1 | 6/2016 | Makovec et al. | |

FOREIGN PATENT DOCUMENTS

| | | | |
|---|---|---|---|
| DE | 19919710 | A1 | 11/2000 |
| DE | 69623562 | T2 | 5/2003 |
| EP | 0449780 | A2 | 10/1991 |
| EP | 1755999 | B1 | 2/2007 |
| FR | 1 416 386 | A | 11/1965 |

* cited by examiner

PALLET OF A MOVING WALKWAY

The invention relates to a base body of a moving-walkway plate, to a moving-walkway plate as well as to a moving walkway with a plate belt, which is guided to circulate between two deflecting regions.

BACKGROUND OF THE INVENTION

The plate belt of a moving walkway can be walked onto by way of access regions connecting with the two deflecting regions. As a consequence of the construction of their deflecting regions, moving walkways usually have a large access height of their access regions. In order that the users do not have to transit a too-large or too-lengthy ramp to the access height a respective pit is provided in the substrate at least in each of the deflecting regions. The major part of the deflecting region can be recessed into these pits so that the plate belt can be walked onto almost at ground level. The plate belt usually has two articulated chains which serve as traction means and between which the moving-walkway plates are arranged. These articulated chains are guided in the deflecting regions over deflecting chainwheels. The large access height of the deflecting regions is attributable particularly to the requisite pitch circle diameter of the deflecting chainwheels so as to avoid the known problem of polygon effect of chain drives. Polygon effect in the case of chain deflection is, according to textbook (Dubbel Taschenbuch für Maschinenbau, 17th Edition, pages G108 to G109), restricted to an acceptable amount if the chainwheels have at least 17 teeth, which for a specific chain link length determines the deflection radius. This measure significantly limits the three-dimensional design. In the field of, in particular, escalators and moving walkways, the chain link length of which is usually given by plate length, the condition of a minimum of 17 teeth signifies an extremely inconvenient restriction. For example, in the case of a chain link length of 200 millimeters, as is quite usual in the case of traction means of plate belts, it limits the deflecting radius towards below approximately 540 millimeters.

EP 1 876 135 B1 does indeed disclose solutions for eliminating polygon effect with chainwheel diameters below the required diameter. The length of the chain links of the traction means, however, limits the minimum possible pitch circle diameter due to the minimum required chain pitch, so that always at least one chain link is in engagement with the chainwheel.

In order to overcome this problem WO2006/003238 A2 discloses a flatly constructed moving walkway in which the moving-walkway plates are changed in movement direction at a turning region, instead of providing deflecting regions with the usual deflection of the moving-walkway plates through 180°. In order that the moving-walkway plates to be changed in movement direction have a sufficient load-bearing capability for an intended width of the plate belt they are very long in relation to the intended running direction. However, the solution proposed in WO2006/003238 A2 has the disadvantage that the mechanical components of the plate belt in the regions of movement direction change can be exposed to substantial acceleration and deceleration forces. As a result, these are usually loaded to a greater extent than in the case of conventional deflection of the moving-walkway plates. Moreover, the abrupt directional change of the moving-walkway plates in the turning regions can lead to rough running of the entire plate belt. In addition, the proposed turning region of the moving-walkway plates requires tracks of the leading rollers separate from the trailing rollers of a moving-walkway plate in order to control transit of each moving-walkway plate through the turning region. Consequently, the overall width of the moving walkway is increased or the conveying width of the plate belt limited.

BRIEF DESCRIPTION OF THE INVENTION

It is an object of the present invention to achieve a flatly constructed moving walkway which has smooth travel behaviour, is of slender construction in relation to the width of its plate belt and the plate belt components of which are moderately loaded in the deflection region.

This object is fulfilled by a moving walkway with two deflecting regions and with a plate belt, which is arranged to circulate between the deflecting regions and which comprises two traction means and a plurality of identically shaped moving-walkway plates. The moving-walkway plates are pivotably interconnected and are arranged between the two traction means. The successively arranged moving-walkway plates are pivotable in the deflecting regions relative to one another about the axes thereof. Each of the moving-walkway plates includes at least one base body continuously extending between the traction means. By the feature "continuously extending base body" there is to be understood a base body extending without interruption between the two traction means, thus is intrinsically load-bearing and serves not just for local reinforcement of the moving-walkway plate. However, a continuously extending base body does not necessarily have to be of integral construction, but can also consist of a plurality of components joined together. The base body has a base surface for attachment of at least one tread element, wherein the base body length of the base surface extends in the intended direction of running of the moving-walkway plate and the width of the base surface extends orthogonally to the intended running direction. A pivot axis extending in the width is defined for the base body by the pivotable connection with a directly following moving-walkway plate. This pivot axis is arranged a plane containing the base surface or above the side of this plane remote from the base body. In addition, the base body has along its width a base body cross-section with a geometric centre of gravity arranged below the base surface.

The base bodies are pivotably interconnected by way of the traction means, wherein the traction means can have pivot points containing the pivot axes.

Through this base body with elevated pivot axis in the plane of the base surface or above the plane surface it is possible to create a moving-walkway plate, of which the tread element during circulation can be deflected in the deflecting region on the pitch circle of the deflecting chainwheel or even on a smaller circular path than the pitch circle. Regardless of whether a deflecting chainwheel without compensation for polygon effect or a deflecting chainwheel according to EP 1 876 135 B1 with compensation for polygon effect is used the access height between a base serving as substrate or foundation and the tread element disposed in the access region can be still further reduced by the base body according to the invention.

The base body can have a base body cross-section, which extends in the width, with an external profile which is adapted to the position of the pivot axis of the base body as well as—referred to the respectively present spaces of the deflecting regions—bounded by the external profiles of identically shaped base body cross-sections of a directly preceding base body and directly succeeding base body, which are pivoted in the deflecting region, of the plate belt. The base body thus has a base body cross-section which extends over its width and which with respect to bending and torsion of the base body has a highest possible section modulus without hindering deflection of the moving-walkway plates in the deflecting region.

In order to create sufficient freedom for pivotation of the moving-walkway plates and in order to maximise the section modulus of the base body the base body cross-section is preferably constructed to be triangular or trapezium-shaped. In the case of the conventional widths of the moving-walkway plate of 800 millimeters to 1500 millimeters and a pitch circle diameter of the deflecting chainwheel of 200 millimeters to 400 millimeters, a sufficient section modulus can be achieved if, starting from the base surface, the base body height of the triangular or trapezium-shaped base body cross-section is 0.5 to 2.5 times the base body length of the base surface. A particularly satisfactory matching of the base body cross-section to the available space in the deflecting region is given when the base body height of the triangular or trapezium-shaped base body cross-section is 0.65 to 1.5 times the base body length of the base surface. The greater the ratio of the base body height to the base body length the further the geometric centre of gravity of the base body cross-section is arranged from the base surface.

The triangular or trapezium-shaped base body cross-section preferably has an internal angle between 35° and 85°. This internal angle lies between a first side leg connecting with the base surface and a second side leg connecting with the base surface, wherein the side legs starting from the base surface are arranged to run towards one another. In order make best possible use of the available space in the deflecting region so as to achieve a high section modulus an internal angle of 50° to 65° is, with particular preference, to be selected.

With respect to the external profile of the base body cross-section the two side legs can be formed to be of different length. However, they can also be arranged with mirror symmetry to a centre longitudinal plane which extends in the width and orthogonally to the base surface and which intersects the base surface centrally. By virtue of the mirror-symmetrical arrangement the base body can be inserted into the plate belt without concern for the running direction. The two side legs do not necessarily have to extend in a straight direction starting from the base surface; they can also be of concave or convex construction.

In order that the individual base bodies are as light as possible, the side surfaces, which extend in the width, of the side legs and/or the base surface have or has recesses.

The base body can, for example, be cast or made from an extruded section.

In one embodiment of the invention the base body is made of sheet metal. The sheet metal can be, for example, aluminium, steel, brass, copper, bronze or stainless steel. The development of the base body is initially cut or punched out of the sheet metal, in which case the recesses can also be produced at the same time. Insofar as the development is punched out, the recesses thereof can be provided with encircling collars and further regions reinforced by corrugations. The triangular or trapezium-shaped base body cross-section can thereafter be formed by means of bent-over portions extending parallel to the width of the base surface.

The sheet metal end edges, which extend in the width, of the afore-described base body of sheet metal can, for example, be arranged to overlap one another and have a region connected with one another. All known forms of weld connections, but also folding of the sheet metal end edges or connection of the same by means of peening, are suitable for connection of the sheet metal end edges. Since the base body is a bending beam and, in the case of use as intended, the base surface thereof takes over the function of a top chord of the bending beam, the region of the triangular or trapezium-shaped cross-section furthest from the base surface serves as a bottom chord. Due to the trapezium-shaped or triangular cross-section of the base body this bottom chord is significantly shorter than the top chord. Accordingly, arrangement of the interconnected sheet metal end edges in the region of this bottom chord is particularly advantageous, since through overlapping of the sheet metal end edges at this location a load-bearing material accumulation is created. Moreover, the side legs and/or the sheet metal end edges thereof of the base body can also be connected by further parts such as frames, intermediate plates and the like.

The sheet metal end edges, which extend in the width, of the base body can obviously also project into the inner side of the base body in order to, for example, increase the stability of shape of the base surface. A further possibility consists of arranging the sheet metal end edges, which extend in the width, in the base surface.

At least one tread element can be fastened to the base body, wherein the tread element length extends, analogously to the base body length of the base surface, in the intended running direction of the moving-walkway plate. If the base body length of the base surface corresponds with 0.6 to 0.95 times the tread element length of the at least one tread element to be fastened a meshing overlap can be created between the tread elements. It is thereby possible to avoid dangerous gaps, which narrow over the walkable transport length of the moving walkway, between adjacent moving-walkway plates in the walkable region of the plate belt.

The base body can obviously also be produced from composite fibre materials and comprise, for example, carbon fibres, aramide fibres and/or glass fibres. A base body made from fibre composite materials is wound or woven and therefore has a continuous outer profile with a triangular or trapezium-shaped cross-section. As a result, an extraordinarily light and durable base body can be produced. By the feature of "continuous outer profile" there is to be understood a tubular cross-section of the base body, wherein this tubular base body can have openings and recesses. Such a base body could be wound on a mandrel, wherein the recesses can be produced by appropriate guidance of the fibres in the base surface and/or in the side surfaces of the side legs.

A plurality of identically shaped moving-walkway plates of the moving walkway according to the invention is arranged between the two traction means and connected by way of connecting points with the traction means to be pivotable relative to one another and thereby form, together with the traction means, a plate belt. By virtue of the pivot connections, moving-walkway plates arranged in succession are pivotable in the deflecting regions relative to one another about the pivot axes thereof. Each of these moving-walkway plates includes at least one base body extending continuously between the two traction means of the plate belt. The base body has a base surface for attachment of at least one tread element, wherein the base body length of the base surface extends in the intended running direction of the moving-walkway plate and the width of the base surface extends orthogonally to the intended running direction. A pivot axis extending in the width is defined for the base body by the pivot connection with a directly following moving-walkway plate. The pivot axis is arranged in a plane containing the base surface or above the side of this plane remote from the base body. The base body has along its width a base body cross-section with a geometric centre of gravity arranged below the base surface. In addition, each moving-walkway plate comprises at least one tread element, which is fastened on the base surface of the base body.

The plates described in the foregoing can be used not only in new, flatly constructed moving walkways, but also in conventional moving walkways with pits. Obviously, an older moving walkway can also be modernised and the guide rails thereof and deflecting regions in a given case adapted to the new plate belt.

The at least one tread element can have projections which are formed at the tread elements and which after placement of the tread element on the base surface protrude through recesses in the base surface into the base body. The at least one tread element can be fastened to the base body by at least one of the following fastening possibilities, such as by means of peening or riveting of the projections, by means of screws, by means of clinching or by means of an adhesive. Particularly suitable as adhesive are pasty or liquid single-component adhesives/sealants on the basis of silane-modified polymers, which cross-link by air moisture to form an elastic product. These are used in, for example, bodywork construction, vehicle construction, carriage construction and container construction as well as in metal construction and apparatus construction.

A particularly simple fastening variant of the tread plates at the base body consists of forming, at at least one tread element, projections which after placing of the tread element on the base surface protrude through recesses in the base surface and the tread element is fastened to the base body by means of spring washer clips arranged at the projections. The position of the recesses, which are described further above, in the side surfaces of the side legs is matched to the position of the projections protruding through the base surface. If the size of the recesses is also matched to the diameter of the spring washer clips, the projections can be equipped with the spring washer clips through the recesses.

BRIEF DESCRIPTION OF THE DRAWINGS

The moving walkway according to the invention, moving-walkway plates of a plate belt arranged in its operating position to circulate between two deflecting regions of the moving walkway, and the base body of a moving-walkway plate are explained in more detail in the following by way of examples and with reference to the drawings, in which.

DETAILED DESCRIPTION OF THE INVENTION

Figure 1:
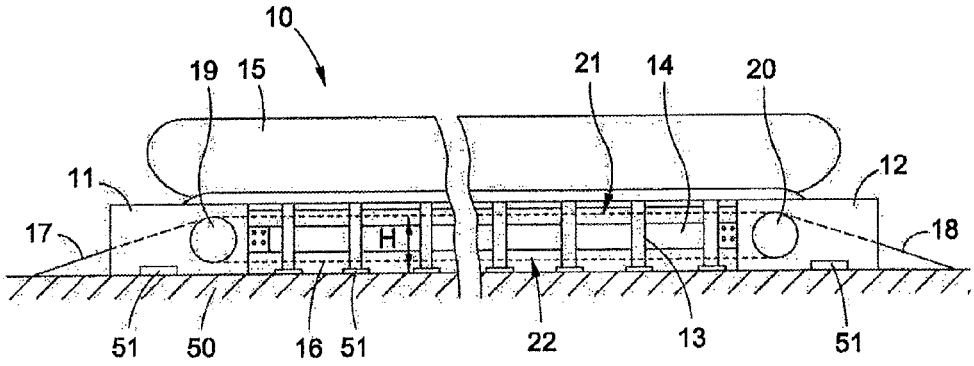
FIG. 1 shows, in schematic illustration, a moving walkway with a support structure and two deflecting regions, wherein guide rails are arranged in the support structure and an encircling plate belt is arranged between the deflecting regions.

FIG. 1 shows, in side view in schematic illustration, a moving walkway 10 which is arranged on a supporting structure 50. Serving as supporting structure 50 is, for example, a floor or concrete foundation having sufficient strength. A steel frame, a steel beam, a concrete ramp and the like can obviously also serve as supporting structure. The floor has mounts 51 on which the components of the moving walkway 10 are fastened. Belonging to these components are a first deflecting region 11 and a second deflecting region 12, as well as support structures 13, guide rails 14, balustrades 15 and a plate belt 16 arranged between the deflecting regions 11, 12. Deflecting chainwheels 19, 20 are rotatably mounted in the deflecting regions 11, 12 and the plate belt 16 is guided to circulate around these deflecting chainwheels 19, 20. Correspondingly, the plate belt 16 forms a forward run 21, which can be walked on by users, and a return run 22 for return of the moving-walkway plates. Moreover, arranged to connect with the deflecting regions 11, 12 are ramps 17, 18 by way of which users reach the walk-on height H and can walk onto or leave the plate belt 16. It is clearly apparent from FIG. 1 that, in the absence of a pit in the supporting structure 50, the spacing or the walk-on height H between the supporting structure 50 and the forward run 21 of the plate belt directly influences the inclination and length of the ramps 17, 18 and thus obviously user comfort.

Figure 2:
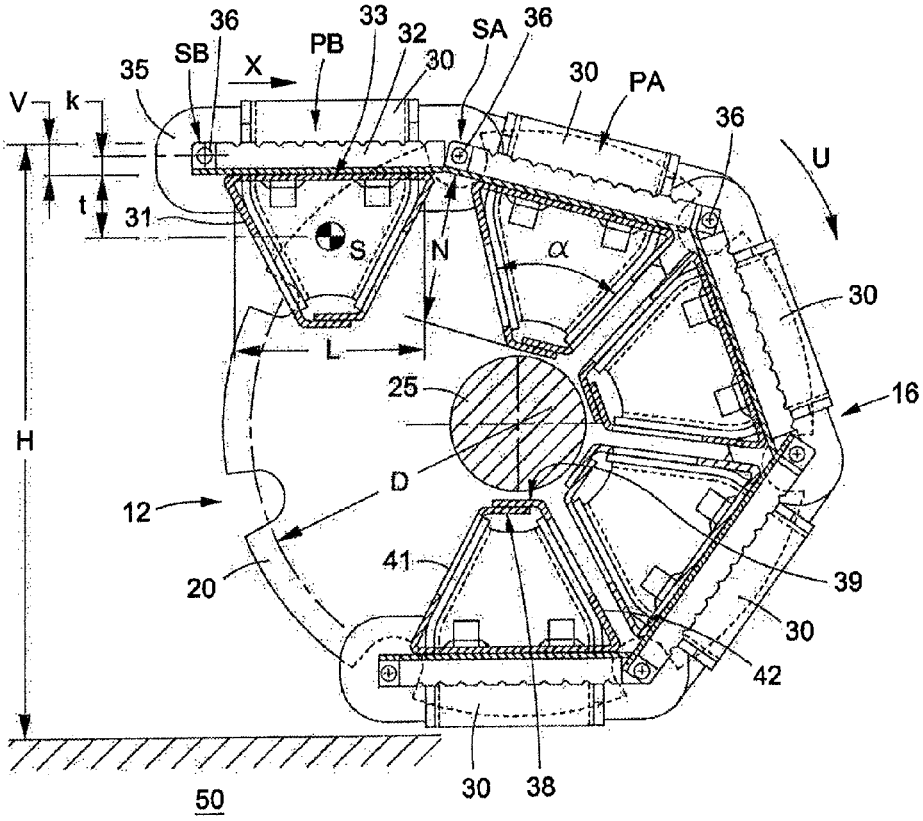
FIG. 2 shows, in schematic illustration, a part of a deflecting region of FIG. 1 in side view with a deflecting chainwheel and with a plurality of moving-walkway plates illustrated in section.
Figure 3:
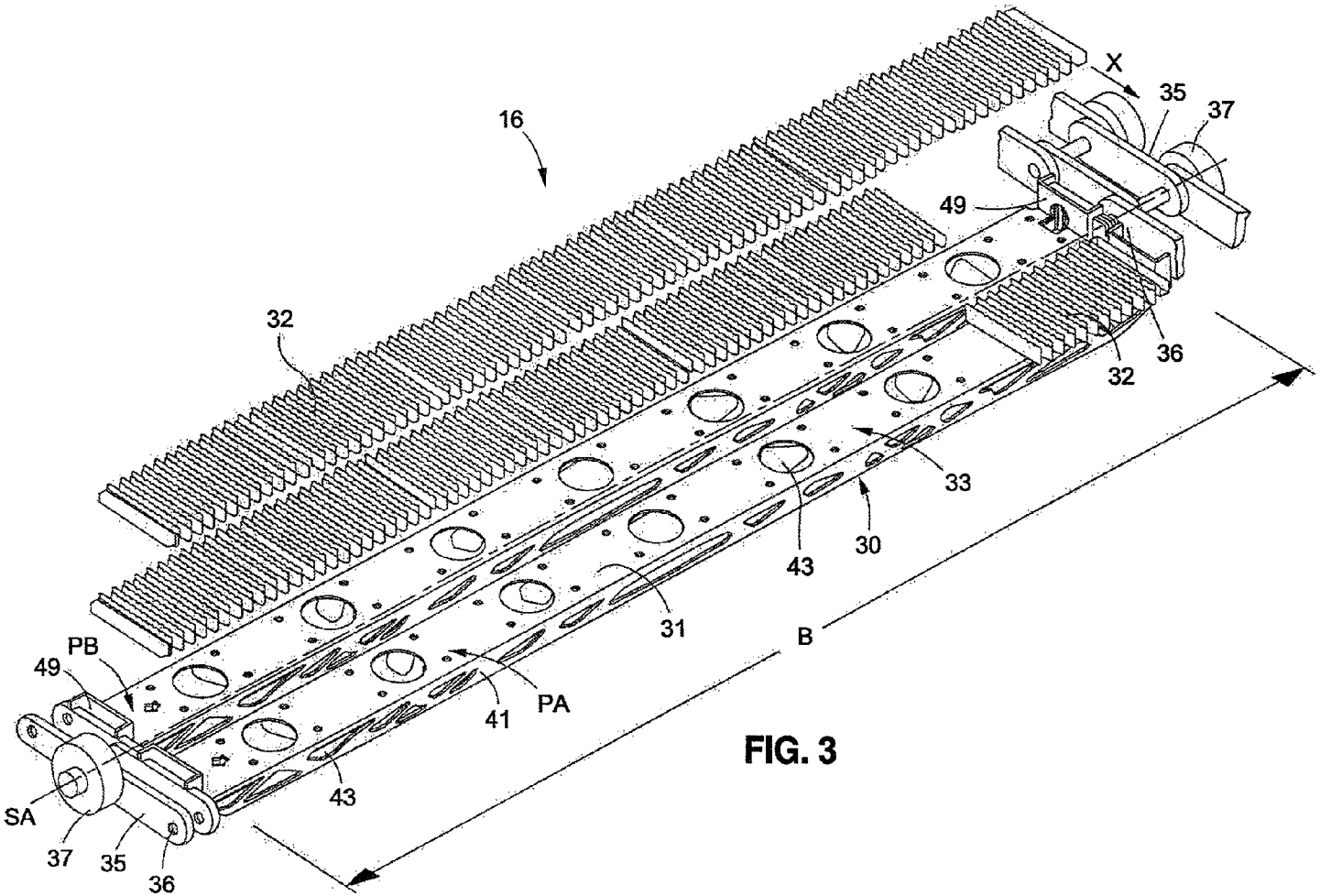
FIG. 3 shows, in three-dimensional view, a part of the plate belt, which is illustrated in FIG. 2, with two traction means, between which two moving-walkway plates of the plate belt are arranged by their base bodies and tread elements in succession and are connected together by way of the traction means.

In the following, FIGS. 2 and 3 are described conjunctively. FIG. 2 shows, in schematic illustration, the deflecting chainwheel 20 of the deflecting region 12 of FIG. 1 in side view as well as a part of the plate belt 16 with several moving-walkway plates 30, which are illustrated in section, with their base bodies 31 and tread elements 32. Each base body 31 has a base surface 33 for fastening at least one tread element 32, wherein the base body length L of the base surface 33 extends in the intended running direction X of the moving-walkway plate 30. The width B of the base surface 30, illustrated in FIG. 3, extends orthogonally to the intended running direction X.

FIG. 3 shows in three-dimensional view a part of the plate belt 16, which is illustrated in FIG. 2, with two traction means 35, at which guide rollers 37 are arranged at the pivot points described further below. The continuously extending base bodies 31 have, at the ends, connecting points 49 by which the base bodies 31 are connected with the traction means 35.

The moving-walkway plates 30 of the plate belt 16 are arranged in succession between the link chains serving as traction means 35 and are connected together by way of the traction means 35. Due to the sectional illustration, only one of the two traction means 35 is visible in FIG. 2. The traction means 35 has pivot points 36, wherein a respective pivot point 36 is arranged between each two successive moving-walkway plates 30 and a pivot axis SA, SB is defined by this pivot point 36. In the simplest way, the association of the pivot axes SA, SB in the example of the moving-walkway plates 30 denoted by PA and PB can be explained. In the case of an assumed running direction X of the moving-walkway plates 30 or a sense of circulation U of the deflecting chainwheel 20 the moving-walkway plate PB follows the moving-walkway plate PA. When the moving-walkway plate PA reaches, as illustrated, the deflecting chainwheel 20 this is pivoted relative to the moving-walkway plate PB about the pivot axis SA associated therewith. Correspondingly, also associated with the following moving-walkway plate PB is pivot axis SB which is defined by the pivot point 36 between the moving walkway plate PB and the moving-walkway plate (no longer illustrated) following this.

The minimum possible pitch circle diameter D of the deflecting chainwheel 30 should not, due to the minimum required chain pitch, be fallen below. In order to further reduce the walk-on height H, the pivot axis SB of the moving walkway plate PB is arranged at a spacing K above a plane containing the base surface 33 of its base body 31. The base surfaces 33 thereby move in the deflecting region 12 on a deflection path having a diameter which is smaller than the minimum pitch circle diameter D of the deflecting chainwheel 20. The spacing k can obviously also be 0, wherein the circulation path of the base surfaces 33 approximately corresponds with the pitch circle diameter D. Subject to the precondition that the tread element thickness v of the tread element does not change, the walk-on height H decreases the greater the spacing k is selected to be. The spacing k can be selected by design of the connecting points 49 described further above.

In order that the moving-walkway plate 30 has a sufficient strength in bending, the base body 31 thereof has along its width B a base body cross-section with a geometric centre of gravity S arranged at a centre-of-gravity spacing t below the base surface 33. The centre-of-gravity spacing t is preferably as large as possible. This can be achieved by means of a base body 31 with a base body cross-section which extends as far as possible into the space below the base surface 33. As FIG. 2 shows, this space or free area is limited particularly in the region of the deflecting chainwheel 20. The continuously extending base body 31 therefore preferably has a base body cross-section with an outer profile which is matched to the position of the pivot axis SA, SB of the base body 31 and which, with respect to the respectively present spaces of the deflecting regions 11, 12, is bounded by the outer profiles of identically shaped base body cross-sections of a directly preceding and directly following base body 31, which is pivoted in the deflecting region 11, 12, of the plate belt 16.

The base body cross-section of the embodiment illustrated in FIG. 2 is of trapezium-shaped construction so that the base body 31 cannot collide with an axis 25 or shaft 25 of the deflecting chainwheel 20 and adjacent, identically shaped base body 31. The trapezium-shaped cross-section of the base body 31 is formed from a sheet metal plate by means of bent-over portions extending in the width B, wherein formed by the bent-over portions are a first side leg 41 and a second side leg 42 which connect with the base surface 31 and which, starting from the base surface 31, extend so as to run towards one another. The two side legs 41, 42 are, in the present embodiment, arranged at an internal angle $\alpha$ of approximately 55° relative to one another. The size of the internal angle $\alpha$ can be dependent on the ratio of the base body length L to the base body height N or normal height N of the base body cross-section as well as on the pitch circle diameter D of the deflecting chainwheel 20.

The sheet metal end edges 38, 39 extending in the width B are arranged to overlap in a plane parallel to the base surface 33 and are connected together. The overlapping sheet metal end edges 38, 39 are preferably welded together by means of spot-welding or rolled-seam welding. The base body 31, which is loaded in bending, is reinforced in ideal manner in its bottom chord zone by the overlapping and welding of the sheet metal end edges 38, 39. The base body 31 is extremely stiff in bending and torsion as a consequence of its tubularly profiled base body cross-section.

It is apparent from FIG. 3 that the base surface 33 and the side surfaces, which extend in the width B, of the side legs 41, 42 have recesses 43 so as to reduce the weight of the base body 31.

It is also to be added that the base body 30 illustrated in FIG. 3 can also be produced from composite materials, particularly fibre composite materials. However, this would then have not an overlapping region as illustrated in FIG. 2, but a continuous external profile without end edges extending in the width. Such a tubularly profiled base body could comprise carbon fibres and/or aramide fibres and/or glass-fibres. In addition, a base body produced from composite materials can have a trapezium-shaped or triangular base body cross-section.

Figure 4:
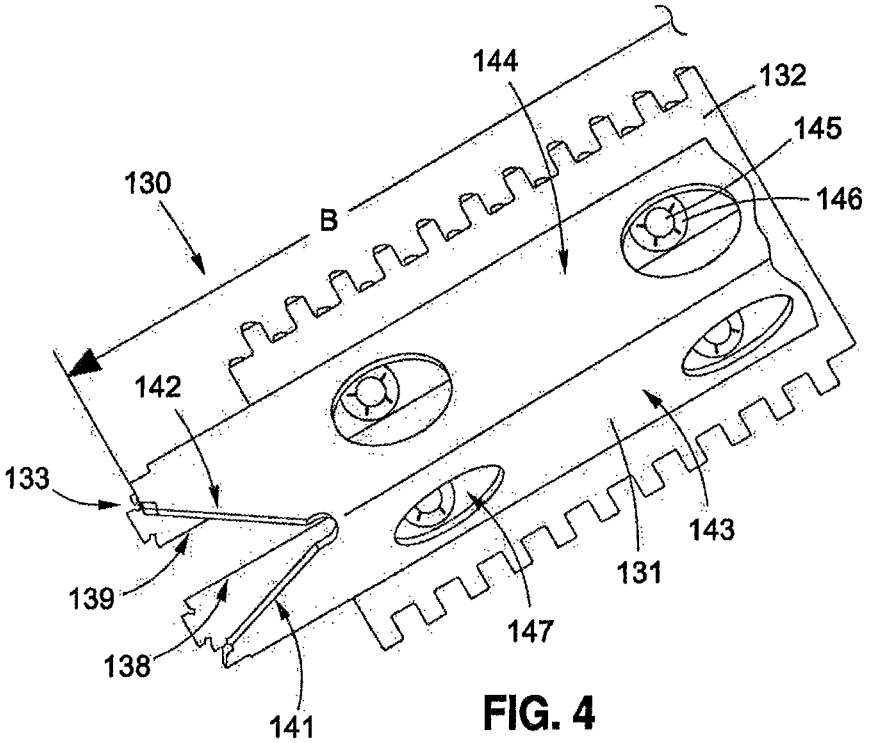
FIG. 4 shows, in three-dimensional underneath view, a part of a base body with a triangular cross-section, wherein a tread element is fastened on the base body by means of spring washer clips.

FIG. 4 shows in three-dimensional underneath view a part of a moving-walkway plate 130 with a base body 131 having a triangular cross-section extending in width, wherein a tread element 132 is fastened on the base body 131. The sheet metal end edges 138, 139, which extend in the width B, of the base body are in this embodiment arranged in the base surface 133 of the base body 131. In addition, formed at the tread element 132 are projections 145 which after placing of the tread element 132 on the base surface 133 protrude through recesses in the base surface 133. The tread element 132 is fastened to the base body 131 by means of spring washer clips 146, also termed spring axial securing devices, securing rings or securing washers, arranged at the projections 145. This base body 131 also has recesses 147 in the side surface 143, 144 of its side legs 141, 142 for the purpose of weight reduction. In order that the spring washer clips 146 can be mounted, the position of the recesses 147 in the side surfaces 143, 144 corresponds with the position of the projections 145 protruding through the base surface 133. Moreover, the size of the recesses 147 is matched to the diameter of the spring washer clips 146.

Figure 5:
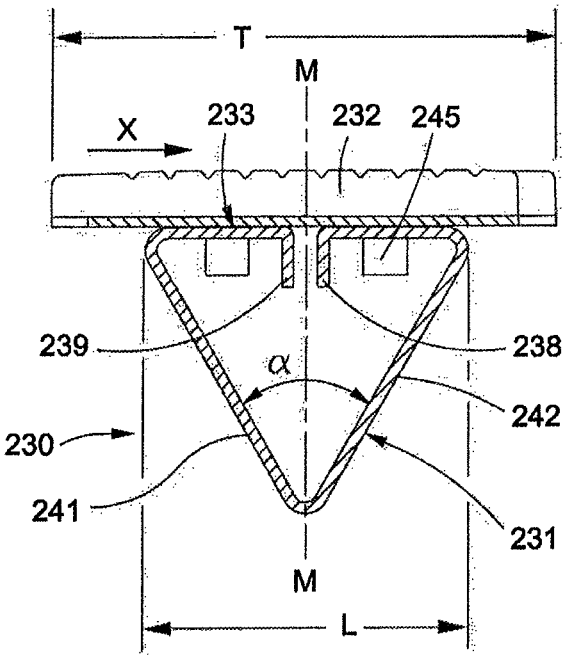
FIG. 5 shows, in sectional side view, a further embodiment of a base body with sheet metal edges, which extend in the width of the base body and which protrude into the inner side of the base body.

FIG. 5 shows a further embodiment of a moving-walkway plate 230 in sectional side view. This has a continuously extending base body 231 with a triangular base body cross-section. The sheet metal edges 238, 239 extending in the width B of the base body 231 protrude into the inner side of the base body 231. The two side legs 241, 242 are arranged at an internal angle $\alpha$ in mirror symmetry with respect to a centre longitudinal plane M-M, which extends in the width and orthogonally to the base surface 233 and centrally intersects the base surface 233.

The at least one tread element 232 has projections 245 which are formed at the tread elements 232 and which after placing of the tread element 232 on the base surface 233 protrude through recesses in the base surface 233 into the base body 231 and position this at the base element 231. The at least one tread element 232 can be fastened to the base body by various fastening variants such as, for example, by means of peening or riveting of the projections, by means of screws or by means of an adhesive. The base body length L of the base surface 233 preferably corresponds with 0.6 to 0.95 times the tread element length T of the at least one tread element 232 to be fastened, wherein the tread element length T analogously to the base body length L of the base surface 233 extends in the intended running direction X of the moving-walkway plate 230. The external profile of the base body cross-section can, as illustrated in FIG. 2, thereby optimally fill out the available space.

Although the invention has been described by illustration of specific embodiments it is obvious that numerous further variants of embodiment can be created with knowledge of the present invention, for example in that the features of the individual embodiments are combined with one another and/or individual functional units of the embodiments are exchanged. For example, only one tread element per moving-walkway plate can be fastened to the base body, which element extends over the entire width of the base body, or, as apparent from FIG. 3, several tread elements can be fastened to the base body. It is also possible for the base body together with the tread plate to be of integral construction, for example as plates produced integrally by means of a die-casting method. In these variants the plane, which contains the underneath view of the tread element and from which the side legs of the base body cross-section extend, counts as the base. Obviously, a moving-walkway plate can also have two continuously extending base bodies, which are arranged parallel to one another and which are connected together by means of one or more tread plates.

In addition, the sheet metal end edges can be connected together in all embodiments. Obviously, all mentioned fastening variants of the tread elements to the base bodies can be used in all embodiments. It is also possible for the continuously extending base body to have a base body cross-section which differs from the trapezium-shaped or triangular cross-sectional shape in that, for example, a polygonal cross-sectional shape is created by means of further folds.

The invention claimed is:

1. A moving walkway with two deflecting regions and a plate belt which is arranged to circulate between the two deflecting regions and which moving walkway further comprises two traction means and a plurality of identically shaped moving-walkway plates, wherein the moving-walkway plates are pivotably interconnected and arranged between the two traction means, and successively arranged ones of the moving-walkway plates are pivotable relative to one another in the deflecting regions about pivot axes thereof, wherein:

each of the moving-walkway plates includes at least one base body continuously extending between the two traction means, the base body has a base surface for attachment of at least one tread element, wherein the base body has a length (L) of the base surface extending in an intended running direction (X) of the moving-walkway plate and a width (B) of the base surface extending orthogonally to the intended running direction (X), a pivot axis extending along the width (B) of the base body is defined by a pivot connection with a directly succeeding moving-walkway plate, the pivot axis being arranged in a plane containing the base surface or above the plane remote from the base body, and the base body has along its width (B) a base body cross-section having a geometric centre of gravity (S) arranged below the base surface.

2. The moving walkway according to claim 1, wherein the distance between the base body's centre of gravity and the base surface is maximized for pivoting of the plates without interference within the deflecting regions.

3. The moving walkway according to claim 2, wherein the base body cross-section is triangular or trapezium-shaped.

4. The moving walkway according to claim 3, wherein starting from the base surface the base body height (N) of the triangular or trapezium-shaped base body cross-section is 0.5 to 2.5 times the base body length (L) of the base surface (33, 133, 233).

5. The moving walkway of claim 4, wherein the base body height (N) is 0.65 to 1.5 times the base body length (L) of the base surface.

6. The moving walkway according to claim 3, wherein the triangular or trapezium-shaped base body cross-section has first and second side legs connected to the base surface and an internal angle ($\alpha$) between the first and second legs of between 35° and 85°.

7. The moving walkway according to claim 6 wherein the internal angle ($\alpha$) is between 50° and 65°.

8. The moving walkway according to claim 6, wherein the two side legs are arranged in mirror symmetry with respect to a center longitudinal plane (M-M) which extends along in the width (B) and orthogonally to the base surface (33, 133, 233) and which centrally intersects the base surface.

9. The moving walkway according to claim 6, wherein the side legs have side surfaces and there is at least one recess in at least one of the base surface and the side surfaces.

10. The moving walkway according to claim 3, wherein the base body is made of sheet metal and the triangular or trapezium-shaped base body cross-section thereof is formed by means of bent-over portions extending parallel to the width (B) of the base surface.

11. The moving walkway according to claim 10, wherein the base body has sheet metal end edges which extend in the width (B) and which are arranged to overlap one another and have interconnected regions.

12. The moving walkway according to claim 10, wherein the base body has sheet metal end edges which extend in the width (B) and which project into an inner side of the base body.

13. The moving walkway according to claim 10, wherein the base body has sheet metal edges which extend in the width (B) and are arranged in the base surface.

14. The moving walkway according to claim 1, wherein the base body is made from a composite material, and the base body cross-section thereof has a continuous outer profile.

15. The moving walkway according to claim 14, wherein the base body is made from a fibre composite material.

16. The moving walkway according to claim 1, wherein the base body length (L) of the base surface is 0.6 to 0.95 times the tread element length (T) of the at least one tread element to be attached to the base body and wherein the tread element length (T) extends analogously to the base body length (L) of the base surface in the intended running direction (X) of the moving-walkway plate.

17. The moving walkway according to claim 1, wherein the moving-walkway plates are connected by way of connecting points with the traction means to be pivotable relative to one another.

18. A moving-walkway plate of a plate belt for a moving walkway of the type having two deflecting regions and a plate belt which is arranged to circulate between the two deflecting regions and which further comprises two traction means and a plurality of identically shaped moving-walkway plates, wherein the moving-walkway plates are pivotably interconnected and arranged between the two traction means, successively arranged ones of the moving-walkway plates being pivotable relative to one another in the deflecting regions about pivot axes thereof wherein:

the moving-walkway plates include at least one base body continuously extending between the two traction means, the base body has a base surface for attachment of at least one tread element, wherein the base body length (L) of the base surface extends in the intended running direction (X) of the moving-walkway plate and the width (B) of the base surface extends orthogonally to the intended running direction (X), a pivot axis, which extends along the width (B) of the base bodies is defined by the pivot connection with a directly succeeding moving-walkway plate, the pivot axis is arranged in a plane containing the base surface or above the plane remote from the base body, the base body has along its width (B) a base body cross-section having a geometric center of gravity (S) arranged below the base surface, and at least one tread element is fastened to the base surface of the base body.

19. The moving-walkway plate according to claim 18, wherein the at least one tread element has projections which are formed at the tread elements and protrude through recesses in the base surface in the base body, and the at least one tread element is attached to the base body by at least one of peening over, clinching, riveting of the projections, by means of screws or by means of an adhesive.

20. The moving-walkway plate according to claim 18, wherein projections are formed at at least one tread element and protrude through recesses in the base surface and the tread element is attached to the base body by means of spring washer clips arranged at the projections, and wherein the base body has side legs having side surfaces with recesses located thereon located, adapted and sized to facilitate the mounting of the spring washer clips on the projections.

* * * * *